United States Patent [19]

Blomqvist et al.

[11] Patent Number: 4,679,748

[45] Date of Patent: Jul. 14, 1987

[54] CANNON-LAUNCHED PROJECTILE SCANNER

[76] Inventors: Åke Blomqvist, Hedgatan 21, 691 35 Karlskoga, Sweden; James Linick, 99 rue de La Faisanderie, 75 116 Paris, France

[21] Appl. No.: 624,631

[22] Filed: Jun. 25, 1984

[30] Foreign Application Priority Data

Jul. 5, 1983 [SE] Sweden ..... 8303830

[51] Int. Cl.[4] ..... F41G 7/00

[52] U.S. Cl. ..... 244/3.19

[58] Field of Search ..... 244/3.19, 3.15

[56] References Cited

U.S. PATENT DOCUMENTS

| | | | |
|---|---|---|---|
| 3,072,365 | 1/1963 | Linscott et al. | 244/3.19 |
| 3,951,358 | 4/1976 | DeLano et al. | 244/3.19 |
| 4,108,400 | 8/1978 | Groutage et al. | 244/3.19 |
| 4,160,974 | 7/1979 | Stavis | 244/3.19 |

FOREIGN PATENT DOCUMENTS

| | | | |
|---|---|---|---|
| 79653 | 5/1983 | European Pat. Off. . | |
| 81421 | 6/1983 | European Pat. Off. . | |
| 2636062 | 9/1981 | Fed. Rep. of Germany . | |
| 2231947 | 12/1974 | France . | |
| 8006457 | 5/1982 | Sweden . | |
| 2044574 | 10/1980 | United Kingdom . | |
| 2129103 | 5/1984 | United Kingdom . | |
| 2144008 | 2/1985 | United Kingdom | 244/3.19 |

OTHER PUBLICATIONS

Seashore, C. R. et al, "Millimeter-Wave ICs for Precision Guided Weapons"; Microwave Journal, Jun. 1983, pp. 51–65.

New Scientist; Aug. 30, 1984, p. 43.

Ryan, J. W., "Guns, Mortars, and Rockets" 1981 Brassay's pp. 168–172.

Jane's Weapon Systems; 1981–1982 pp. 38–39.

Applied Optics, vol. 19, No. 18; Sep. 1980 pp. 3054–3056.

*Primary Examiner*—Charles T. Jordan

*Attorney, Agent, or Firm*—Dominik, Stein, Saccocio & Reese

[57] ABSTRACT

An artillery shell radar system is disclosed including an antenna directed off axis to produce, in conjunction with the spin of the artillery shell, a conical scan of the target area, with the off axis angle being adjustable by changing the phase shift used in a phased array. Radiation reflected from the target after transmission by a transmitter within the artillery shell is processed to detect and select a target whose position is used to guide the artillery shell by adjustment of guide fins. Gyroscopic inertial navigation equipment and ECM detection may be included.

11 Claims, 3 Drawing Figures

CANNON-LAUNCHED PROJECTILE SCANNER

BACKGROUND OF THE INVENTION

1. Field of the Invention

This invention relates to cannon-launched projectiles. More particularly, this invention relates to an apparatus and method for scanning a target area to select a target located therein and for providing target position information to the guidance system of the projectile to guide the projectile to impact the selected target.

2. Description of the Prior Art

It is well-known that a cannon-launched projectile is a projectile which is launched from a cannon by means of an explosive charge. It is also well-known that the anticipated trajectory of the projectile when launched can be fairly well calculated. This enables the gunner to fire the projectiles to impact a pre-selected target area with reasonable consistency.

Obviously, one of the major disadvantages to the cannon-launched projectile is the inability to control the flight of the projectile after the projectile is launched. One major advancement in this art has been the discovery that fins could be incorporated within the projectile which, after launching, would move from a retracted position in the projectile to an extended position. Usually, the fins are configured to controllably spin the projectile during flight. It was soon found that the spinning projectile is indeed more stable during flight, thereby increasing the accuracy of the projectiles in impacting the target area. Although these significant advancements have been made, there still exists a great need in the industry to be able to control the flight of the projectile after launching, so as to locate and then impact a particular target.

Heretofore, the use of radar techniques incorporated within the projectile have been unsuccessful. The primary reasons for the inability to incorporate a radar in the projectile has been the enormous acceleration (typically 170,000 $m/s^2$) to which the projectile is exposed during the launch. It is, therefore, difficult for any type of moving mechanical device incorporated within the projectile to survive the launch. Thus, any type of state-of-the-art scanning or tracking radar, such as those that utilize sequential lobing, conical scan, or simultaneous lobing or monopulse, requires the use of an oscillatory or rotating antenna or feed horn to transmit and receive a radar beam for locating a potential target and computing an error signal representative of the locating of the target. Obviously, any type of oscillating or rotating antenna or feedhorn would have difficulties to survive a launch.

Another difficulty that is inherent in such state-of-the-art radars, that have been discussed for cannon launched projectiles, is that radar echoes are obtained from such a large area on the ground that the ground clutter echoes will be more powerful than the echo from a potential target, which subtends only a very small part of the area covered by the radar radiation.

Another primary disadvantage to present thoughts about cannon-launched projectiles is the inability to hit a moving target which requires that an inertial reference can be established. It is well-known in the art of missile guidance that in order to hit a moving target, it is necessary to use a proportional navigating guidance system. This requires the inertial rate of the line of sight vector to be determined which, of cource, can not be performed without an inertial reference.

For the reasons stated above, mechanical state-of-the-art gyroscopes are unsuitable to establish the required inertial reference due to the fact that such mechanical gyros would not survive the enormous acceleration of the launch. Although there exists some potential to track the clutter background of the target area to establish a fixed reference directly from the ground, such a procedure would accurately establish an inertial reference only with respect to very limited types of clutter backgrounds. Accordingly, not only has there been a failure to overcome the problem of scanning, there also exists the significant problem of establishing an inertial reference for use during the tracking of a moving target.

Therefore, it is an object of this invention to provide an apparatus and method which overcomes the aforementioned inadequacies of the prior art devices and provides an improvement which is a significant contribution to the cannon-launched projectile art.

Another object of this invention is to provide an apparatus and method for controlling the flight of a cannon-launched projectile after the projectile is launched.

Another object of this invention is to provide an apparatus and method for controlling the flight of the cannon-launched projectile with sufficient ruggedness to survive the enormous acceleration of the projectile during the launch.

Another object of this invention is to provide an apparatus and method to detect a target that subtends only over a very small part of the area covered by the radiation from the radar transmitter.

Another object of this invention is to provide an apparatus and method for controlling the flight of the cannon-launched projectile to impact a selected target located within a predetermined target area.

Another object of this invention is to provide an apparatus and method for controlling the flight of a cannon-launched projectile to scan the target area to select a potential target, track the selected target if moving, and then alter the trajectory of the projectile to impact the selected target.

Another object of this invention is to provide an apparatus and method for controlling the flight of a cannon-launched projectile which utilizes rate gyro means which are sufficiently hard to withstand the acceleration of the launch to establish the inertial reference needed for tracking a moving selected target.

The foregoing has outlined some of the more pertinent objects of the invention. These objects should be construed to be merely illustrative of some of the more prominent features and applications of the intended invention. Many other beneficial results can be attained by applying the disclosed invention in a different manner or modifying the invention within the scope of the disclosure. Accordingly, other objects and a fuller understanding of the invention may be had by referring to the summary of the invention and the detailed description describing one preferred embodiment in addition to the scope of the invention defined by the claims taken in conjunction with the accompanying drawings.

SUMMARY OF THE INVENTION

The invention is defined by the appended claims with a specific embodiment shown in the attached drawings. For the purpose of summarizing the invention, the invention comprises an apparatus and method for guiding the flight of a cannon-launched projectile to impact a target. More particularly, the apparatus of the invention comprises an antenna which is aimed forwardly of the projectile in a position off-set from the axis of the projectile by a predetermined, possibly variable, squint angle. The information received by the antenna is supplied to a signal processor and target position computer which processes the same to select a target, track the selected target if moving, and then continuously produce an error signal representative of the location of the target. The error signal is then supplied to the guidance system of the projectile. The guidance system illustrated hereinafter comprises one or more fixed fins which cause the projectile to spin about its axis during flight and one or more guide fins which are movable to control the direction of flight of the projectile based upon information contained within the error signal.

The method of the invention then comprises the steps of spinning the projectile at a particular frequency by virtue of fixed or movable fins such that the antenna conically scans a target area. A typical value of the spin frequency is 25 rev/sec. The signal processor and target position computer processes the information received by the conical scan of the antenna to compute the distance and direction in which the target is located away from the aimpoint of the projectile and then produces an error signal. This error signal is then supplied to the guidance system of the projectile to control the movement of the guide fins so as to alter the trajectory of the projectile to relocate its aimpoint on the selected target to impact the same.

The apparatus of the invention further includes a navigational system which utilizes one or more rate gyros to establish an inertial reference during flight. This inertial reference is supplied to the target position computer so as to enable the computer to track a moving target, without the necessity of tracking the clutter background to establish a fixed reference directly from the ground.

All of the components of the apparatus of the invention are appropriately fabricated to survive the enormous acceleration of the projectile during launch. Specifically, it is noted that the antenna located off-axis is a fixed antenna which contains no moving parts by which can still accomplish conical scanning by virtue of the stabilizing spin of the projectile as caused by the fixed fins. Additionaly it is noted that the proposed gyros are sufficiently accurate to establish the inertial reference and sufficiently hard to withstand the cannon launch. Finally, it is noted that the signal processor and the target position computer, being fabricated by state-of-the-art semiconductor technology, can similarly withstand the enormous acceleration of the projectile during launch. The only mechnaically movable devices of the apparatus of the invention are the fixed fins and the guide fins which pop out of the projectile after the launch. It has been established in the industry that such fixed fins designed to pop out of the projectile can be designed to withstand the acceleration of the projectile during launch. Thus, it should be equally realizable that similar guide fins can be moved slightly during flight so as to control the flight of the projectile. Another possibility is to use the movable fins to control both the spin rate and the flight path of the projectile. It is also possible that only a part of the projectile is rotating in a controlled way and e.g. the aft fins are free-rolling.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

DESCRIPTION OF THE DRAWINGS

For a fuller understanding of the nature and objects of the invention, reference should be had to the following detailed description taken in connection with the accompanying drawings in which.

Similar reference charcters refer to similar parts throughout the different views of the drawings.

DETAILED DESCRIPTION OF THE PREFERRED EMBODIMENT

Figure 1:
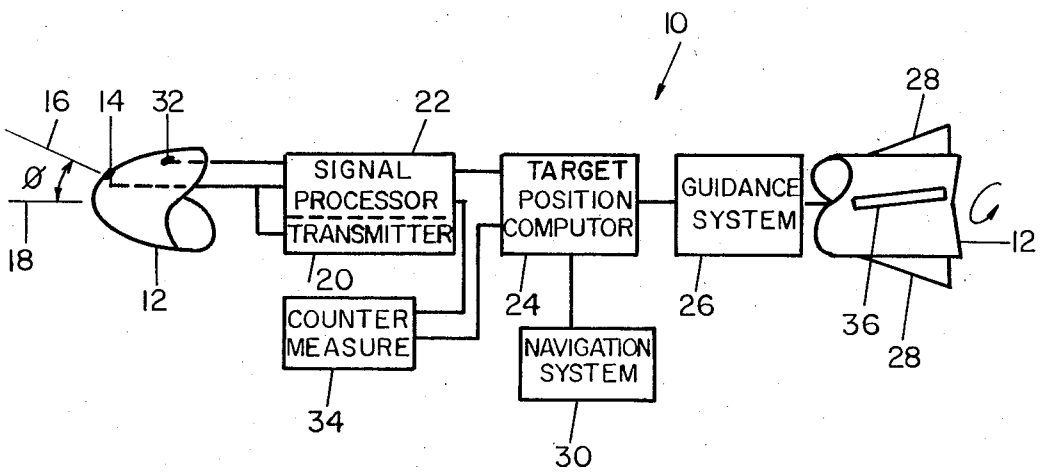
FIG. 1 is a block diagram illustrating the appartus of the invention.

FIG. 1 is a block diagram illustrating the apparatus of the invention. Basically, the apparatus comprises a scanning and tracking radar system, generally indicated by the numeral 10, which is incorporated within a cannon-launched projectile 12. More particularly, the radar system 10 comprises an antenna 14 which is aimed forwardly of the projectile 12. The antenna 14 is a fixed antenna which transmits and receives a staring beam 16 at a squint angle $\phi$ with respect to the axis 18 of the projectile 12. As will be discussed later in further detil, the squint angle $\phi$ may be altered, by electronic plase control or under frequency control during operation.

The antenna 14 is conventionally connected to a transmitter 20 and a signal processor 22 such that the signal processor 22 receives reflections of the transmitted beam 16 from the target area. The signal processor 22 processes the received signal to recover the target information therefrom, and then supplies such information to a target position computer 24. The target position computer 24 selects a preferred target over other targets which may be present, computes the location of the selected target with respect to the aimpoint of the projectile 12, and computes an error signal representative thereof. The error signal is then supplied to the guidance system 26 which controls the direction of the projectile 12 by means of one or more guide fins 28 extending from the projectile 12.

A navigation system 30, which includes a rate gyro (discussed later in further detail), is provided to establish an inertial reference for use by the target position computer 24 to enable the target position computer 24 to track moving targets. A vertical reference is obtained by means of an auxiliary antenna port 32. When the radar radiation from this port hits the ground perpendicularly, which occurs once each revolution, a strong echo is obtained, establishing a vertical reference plane through the axis of the projectile. Additionally, the signal processor 22 may include a passive second channel to receive passive millimeter input from the target area. Further, the passive channel of the radar may include counter-measure detection circuitry 34 to detect counter-measures. The counter-measure information is then supplied to the target position computer 24 to alter the transmitting frequency of the radar beam 16.

Figure 2:
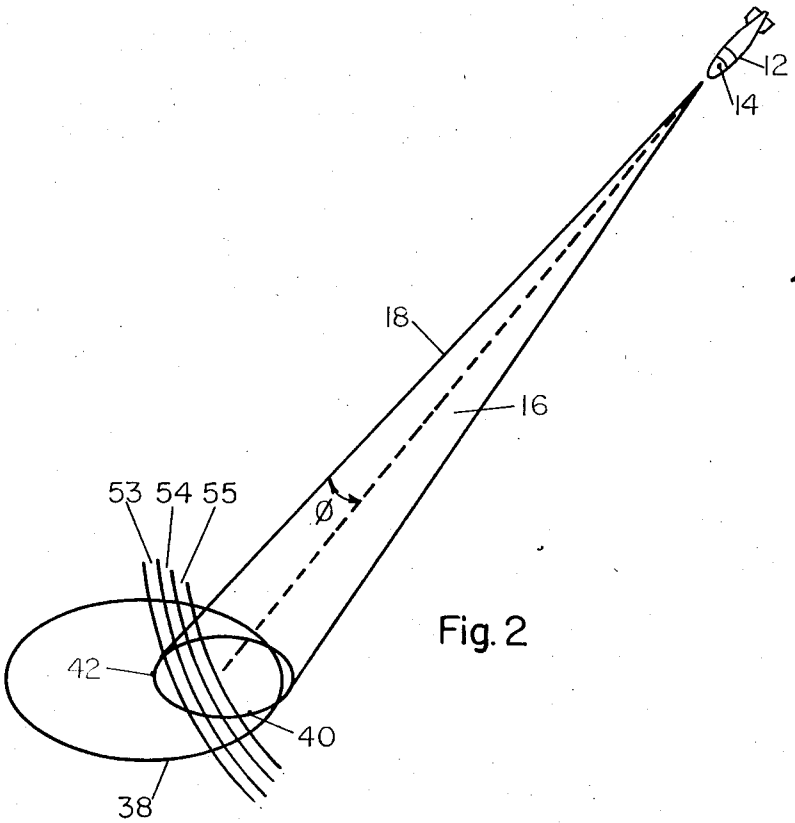
FIG. 2 is a schematic representation of a spinning projectile scanning a target area according to the method of the invention.

FIG. 2 illustrates the novel method of the invention. Specifically, the method of the invention comprises the steps of spinning the projectile 12 by means of one or more fixed fins 36. The radar beam 16 emitted from the antenna 14, being off-set from the axis 18 by the angle $\phi$ causes a footprint 40 to be imaged onto the ground plane. As the projectile 12 spins, the beam footprint 40 is caused to conically scan the target area 38 about the aimpoint 42 of the projectile 12.

The radar system proposed is of the FMCW type with a linear frequency modulation in a sawtooth fashion. By mixing the received echo signal with the transmitted signal, a low frequency signal is obtained, the frequency of which is proportional to the range. In the radar receiver, a bank of band-pass filters is arranged. As the projectile approaches the ground at a certain angle as shown in FIG. 2, this filter bank resolves the "foot print" 40 of the antenna beam in a number of range strips, a few of which 53, 54, 55 are shown in FIG. 2.

An improved signal-to-clutter ratio can be achieved by providing a plurality of range gates. By comparing the levels of the center range gates to the levels of the range gates closest and farthest away, the target-plus-clutter levels can be compared to the clutter-only levels, respectively. Thus, the clutter-only levels, derived from the range gates closest and farthest away, can be used to set a threshold level for the center range gates to be representative of an acceptable target. The threshold level should be set to minimize the false alarm rate while maximizing the corresponding probability of detection.

It should be appreciated that the conical scanning of the target area 38 operates in a manner similar to conventional conscanning and tracking antennas. That means that the direction of the vector from the aimpoint 42 to the target can be determined. In order to pinpoint the target, it is necessary to determine also the length of the vector. This is accomplished by giving the antenna beam a monopulse pattern in the radial direction and making the angle $\phi$ between the center of the beam 40 and the axis 18 of the projectile electronically controlled.

Figure 3:
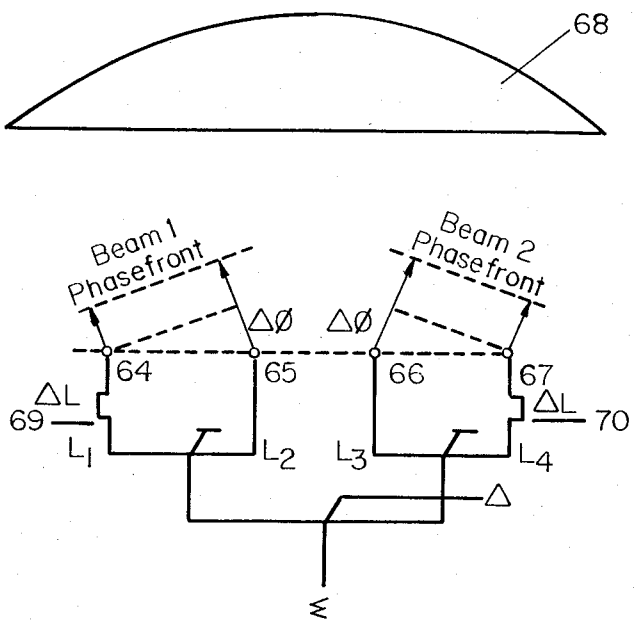
FIG. 3 is a schematic representation of the phase shift controlled antenna system.

FIG. 3 shows an example of the antenna design. It consists of an array of feeds 64, 65, 66 and 67 illuminating a dielectric lens 68. This produces two beams in slightly different directions due to the phase shifters 69 and 70. These two beams are combined to a sum beam $\Sigma$, corresponding to beam 40 in FIG. 2, and a difference beam $\Delta$ having a null at the center of the sum beam. The phase shifters 69 and 70 can be controlled electronically in such a way that the angle $\phi$ can be changed. By this arrangement, any target appearing within the ellipse 38 can be tracked. Finally, it should be appreciated that, as the projectile 12 moves toward the target, the size of the target area 38 decreases.

As noted earlier, an inertial reference must be established to provide accurate guidance toward a potentially moving target. The inertial reference established by the method of the invention is accomplished through the use of a rate gyro which is sufficiently accurate to provide the necessary inertial and vertical reference data and also sufficiently hard to withstand the acceleration of the projectile during launch. Such gyros exist on the market, for instance, solid-state gyros. One example of such a rate gyro is the McDonnell Douglas solid-state phase-nulling optical gyro illustrated in Applied Optics/Vol. 19, No. 18/September 1980, the disclosure of which is incorporated by reference herein.

The particular radar system, operating frequencies, etc., selected are highly subjective. In order to set forth the best mode of the invention, the following is a summary description of the particular radar system 10 which is presently contemplated to be used to accomplish the invention.

It is contemplated that the antenna 14 will have an effective aperture of approximately ten centimeters and that the transmitting frequency of the beam 16 will be approximately thirty-five GHz. With an initial turn-on range of two thousand meters, the width of the footprint 40 will be approximately two hundred eighty-four meters. It is also contemplated that the radar system 10 will have phase shift sensitive pattern that will allow the squint angle of the beam 16 to be rapidly changed during the tracking of the selected target. This feature allows the radar system 10 to place the target at the null of a position discriminate, thereby providing accurate location of the target at all positions within the radar's field of view.

As stated before, after the target is detected and selected, the phase shifters 69 and 70 are set to a phase shift that produces a radar beam 16 offset that centers beam on the position of the target as it sweeps past so that the $\Delta$ signal will be null and the $\Sigma$ signal maximum at that moment. The measured target position and the seeker field of view will be referenced by the inertial reference provided by the gyro and the ground. Using this position information combined with the inertial reference, the optimal guidance course can be determined for the projectile 12.

A second technique for obtaining centroid aimpoint information involves utilizing the passive channel of the radar receiver as a passive radiometer. To the radiometer, the target will generally appear "cold" (reflection of the sky) against the warmer ground. Through a measurement of ground-to-sky temperature made during the flight by the auxiliary antenna port 32, and knowing the range to the target, the temperature modulation pattern is used to provide angular boresight information to the radar system 10.

The present disclosure includes that contained in the appended claims as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

We claim:

1. A cannon-launched projectile, comprising in combination:

radar means including an antenna fixed at a predetermined angle with respect to the axis of the projectile;

said radar means including means for processing information received by said antenna to detect and select a potential target;

said radar means also comprising several range gate means to obtain a good signal to clutter ratio;

said radar means further comprising target position computer means for computing the location of the target selected by said processor means; and guidance system means including one or more guidable fins to alter the direction of flight of the projectile based upon directional information received from said target position computer means.

2. The cannon-launched projectile as set forth in claim 1, wherein the said radar means comprises an active radar means including a transmitter for transmitting a staring beam from said antenna such that said antenna conically scans a target area.

3. The cannon-launched projectile as set forth in claim 2, wherein the frequency of said transmitted beam from said antenna is adjustable so as to adjust the squint angle between the staring beam and the axis of the projectile.

4. The cannon-launched projectile as set forth in claim 2, wherein the said beam from said antenna is controlled by electronic phase shift control so that the squint angle between the controlled beam and the axis of the projectile can be adjusted.

5. The cannon-launched projectile as set forth in claim 4, wherein said electronically controlled beam is arranged to give a sum beam having its maximum antenna gain in said squint angle and a difference beam having antenna gain null in said squint angle.

6. The cannon-launched projectile set forth in claim 2, 3, 4, or 5 comprising one or more fins designed to rotate the projectile or part of it about its axis during flight to produce a conical scanning effect of the antenna.

7. The cannon-launched projectile as set forth in claim 1, further including inertial reference means for establishing an inertial reference to said target position computer means enabling said computer means to track a selected target.

8. The cannon-launched projectile as set forth in claim 5, wherein said radar means comprises an auxiliary antenna port, the echo signal from which establishes a vertical reference.

9. A method for controlling the flight of a cannon-launched projectile, comprising the steps of:

conically scanning a target area by means of an antenna fixed off-axis with respect to the axis of the projectile;

processing information received by said antenna to detect and select a potential target;

computing the location of the selected target; and altering the trajectory of the projectile to impact the selected target.

10. The method as set forth in claim 9, further including the step of transmitting a staring beam from the antenna such that the antenna receives reflections of said beam from the target area for subsequent target position processing.

11. The method as set forth in claim 9, further including the step of establishing an inertial reference enabling a computer to track a moving target.

* * * * *